US008573585B1

(12) United States Patent
Boucher et al.

(10) Patent No.: US 8,573,585 B1
(45) Date of Patent: Nov. 5, 2013

(54) MEDIA HANDLING SYSTEM

(75) Inventors: Peter J Boucher, Vancouver, WA (US); Garrett Clinton Waycaster, Gainesville, FL (US); Andrzei Romanski, Vancouver, WA (US); Mark D Lund, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/484,021

(22) Filed: May 30, 2012

(51) Int. Cl.
*B65H 5/00* (2006.01)
*B65H 1/18* (2006.01)

(52) U.S. Cl.
USPC ... 271/10.03; 271/110; 271/117; 271/258.01; 271/153

(58) Field of Classification Search
USPC ..... 271/10.03, 10.09, 110, 117, 258.01, 271/153, 154, 155
See application file for complete search history.

(56) References Cited

U.S. PATENT DOCUMENTS 3,951,264 A * 4/1976 Heidecker et al. ..... 206/308.3
4,564,792 A 1/1986 Fukushi
5,531,435 A 7/1996 Momose
8,113,504 B2 * 2/2012 Cahill ..... 271/152
2006/0071416 A1 4/2006 Mizuno
2009/0066009 A1 * 3/2009 Matsushima et al. ..... 271/18
2009/0174733 A1 7/2009 Balcan
2010/0032893 A1 * 2/2010 Koga et al. ..... 271/110
2010/0133740 A1 * 6/2010 Kelty et al. ..... 271/110
2011/0102865 A1 5/2011 Ishida et al.
2012/0025450 A1 * 2/2012 Yamamoto ..... 271/110
2012/0104682 A1 * 5/2012 Blair et al. ..... 271/117

FOREIGN PATENT DOCUMENTS

JP 9030669 2/1997
WO 2011116077 9/2011

* cited by examiner

*Primary Examiner* — David H Bollinger

(57) ABSTRACT

A non-transitory storage medium is disclosed herein. An example of the non-transitory storage medium includes instructions that, when executed by a processor, cause the processor to actuate a pick assembly of a media handling system to select a sheet of medium from a media stack and lower the media stack a predetermined amount and subsequently raise the media stack the predetermined amount upon failure to pick the sheet of medium from the media stack. The non-transitory storage medium may include additional instructions as disclosed herein. A media handling system and method of media handling are also disclosed herein.

15 Claims, 8 Drawing Sheets

MEDIA HANDLING SYSTEM

BACKGROUND

End-users and operators appreciate reliability and performance in printing devices. Downtime due to malfunctions is undesirable and can lead to frustration on the part of such end-users and operators. This, in turn, can result in lost sales, warranty service support costs, and even printing device returns for businesses. Businesses may, therefore, endeavor to design printing devices directed toward one or more of these objectives to mitigate such problems.

BRIEF DESCRIPTION OF THE DRAWINGS

The following detailed description references the drawings, wherein.

DETAILED DESCRIPTION

Figure 1:
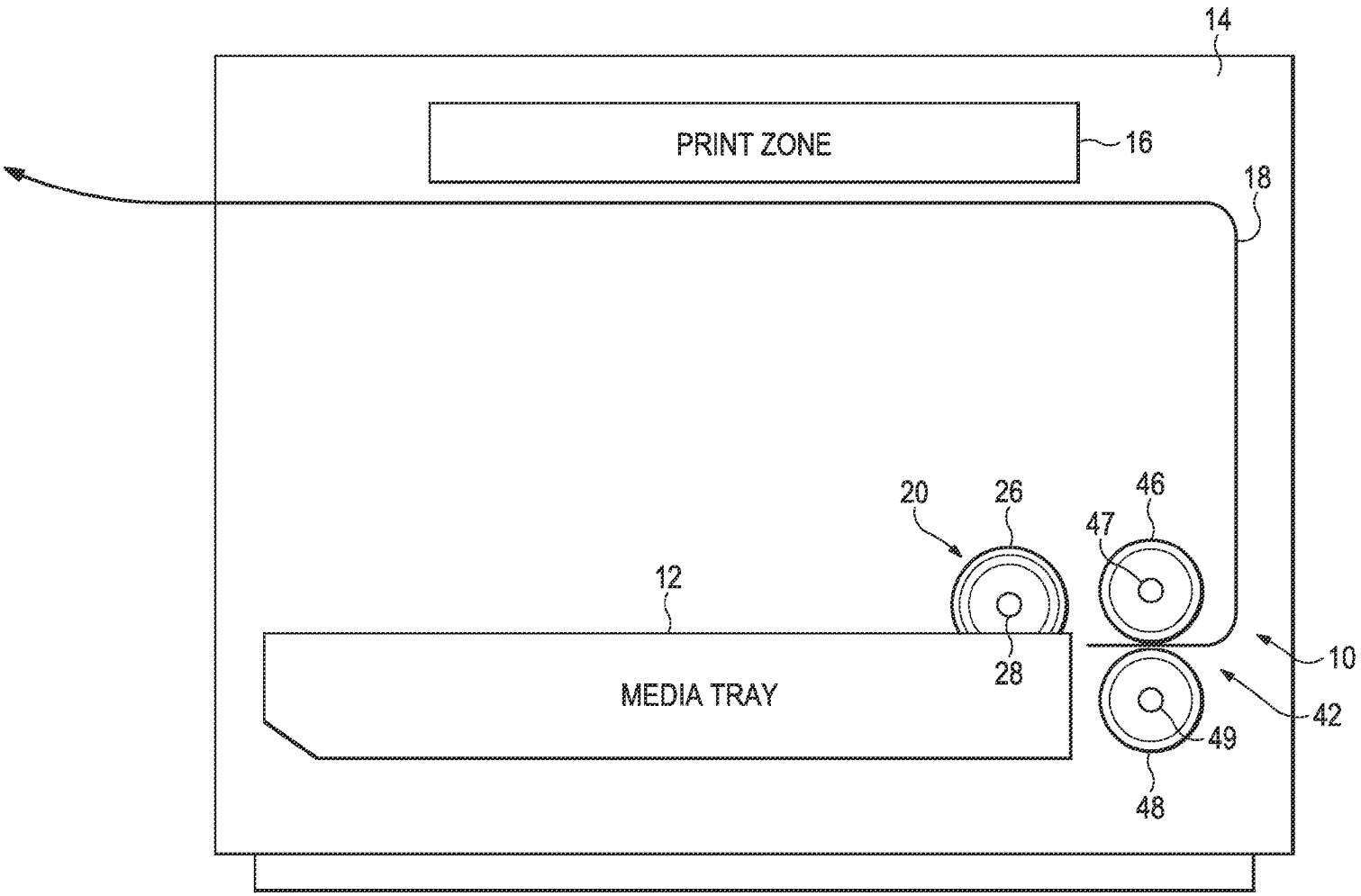
FIG. 1 is a diagrammatic view of a media handling system in a printing device.

Reliability and performance of printing devices is desirable. Throughput, such as printed sheets per minute, is also desirable. The ability to utilize a variety of different types (e.g., glossy, matte, plain, etc.) and sizes (3×5, 4×6, 8×10, letter, legal, A4, etc.) of media while also minimizing downtime due to medium sheet jams within printing devices is also a design consideration. This helps maintain end-user and operator satisfaction which also mitigates lost sales, warranty service support costs, and printing device returns for businesses. An example of a media handling system 10 directed toward such objectives is shown in FIG. 1.

As used herein, the terms "non-transitory storage medium" and non-transitory computer-readable storage medium" are defined as including, but not necessarily being limited to, any media that can contain, store, or maintain programs, information, and data. Non-transitory storage medium and non-transitory computer-readable storage medium may include any one of many physical media such as, for example, electronic, magnetic, optical, electromagnetic, or semiconductor media. More specific examples of suitable non-transitory storage medium and non-transitory computer-readable storage medium include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, an Application Specific Integrated Circuit (ASIC), or a hardware and/or software system that can fetch or obtain the logic from a non-transitory storage medium or a non-transitory computer-readable storage medium and execute the instructions contained therein. "Processor" can also include any controller, state-machine, microprocessor, cloud-based utility, service or feature, or any other analogue, digital and/or mechanical implementation thereof.

As used herein "printing device" is defined as including, but not necessarily being limited to, a printer that uses any of the following marking technologies or a combination thereof: ink jet, laser jet, dye sublimation, liquid toner, off-set printing, or dot matrix. As used herein "media" is defined as including, but not necessarily being limited to any type of paper or other printing medium (e.g., cloth, canvas, transparency, etc.), having any type of finish on either or both sides (e.g., glossy, matte, plain, textured, etc.), in any size, shape, color, or form sheet, roll (cut or uncut), folded, etc.).

As can be seen in FIG. 1, media handling system 10 lies adjacent a media input tray 12 within a printing device 14. Media handling system 10 is designed to covey sheets of medium from media input tray 12, past a print zone 16 that includes a printing mechanism (not shown) for forming an image and/or text onto the sheets of medium, to an exit (also not shown), as generally indicated by path or arrow 18, where it may be finished (e.g., laminated, cut, fused, collated, etc.) and collected by one or more end users and/or operators.

Figure 2:
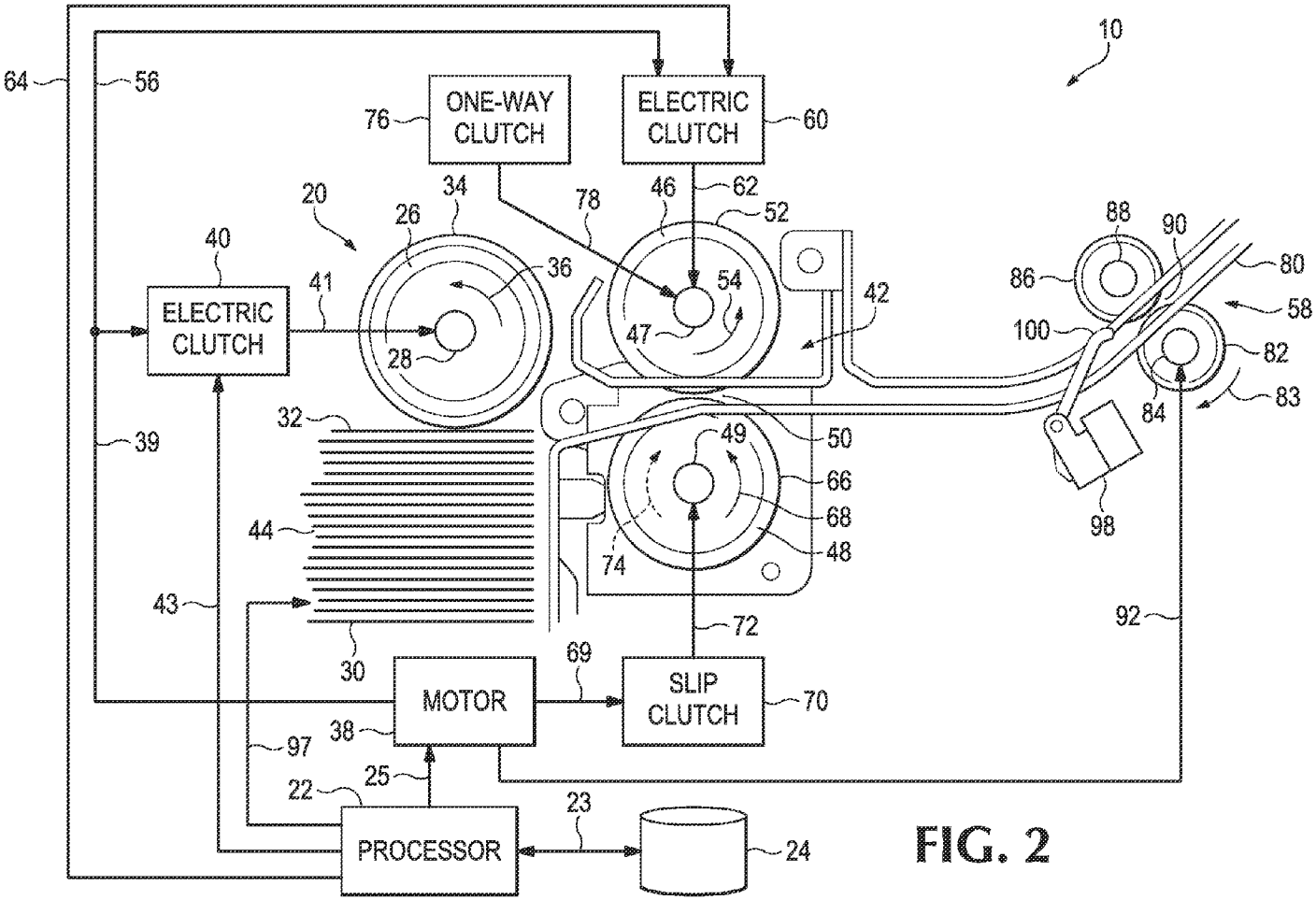
FIG. 2 is an enlarged diagrammatic view of the media handling system of FIG. 1.

An enlarged diagrammatic view of media handling system 10 illustrating additional elements or components thereof is shown in FIG. 2. As can be seen in FIG. 2, media handling assembly 10 includes a pick assembly 20, a processor 22, and anon-transitory storage medium 24. In the example shown, pick assembly 20 includes a roller 26 rotatably mounted on a shaft 28 adjacent a media stack 30 that includes a plurality of sheets of medium such as top sheet of medium 32. Pick roller 26 includes a surface 34 having a sufficient coefficient of friction that, when rotated in the direction of arrow 36 by motor 38, as generally indicated by arrow 39, will select top sheet of medium 32 from media stack 30. Motor 38 is selectively engaged with and disengaged from pick roller 26 by an electric clutch 40, as generally indicated by arrow 41, controlled by processor 22, as generally indicated by arrow 43, which receives instructions stored on non-transitory storage medium 24, as generally indicated by double-headed arrow 23. Processor 22 also controls motor 38, as generally indicated by arrow 25.

As can also be seen in FIG. 2, media handling assembly 10 additionally includes a separator assembly 42 to singulate sheet of medium 32 from any other sheets 44 in media stack 30 inadvertently selected by pick assembly 20. Separator assembly 42 includes a first roller 46 rotatably mounted on a shaft 47 and a second roller 48 rotatably mounted on a shaft 49 and adjacent first roller 46 to define a separator nip 50. First roller 46 includes a surface 52 having a sufficient coefficient of friction that, when rotated first direction of arrow 54 by motor 38, as generally indicated by arrow 56, will help to transport selected top sheet of medium 32 from media stack 30 toward feed assembly 58. Motor 38 is selectively engaged with and disengaged from first roller 46 by an electric clutch 60, as generally indicated by arrow 62, controlled by processor 22, as generally indicated by arrow 64, which receives instructions stored on non transitory storage medium 24, as generally indicated by double-headed arrow 23.

Second roller 48 includes a surface 66 having a sufficient coefficient of friction that, when rotated in second direction of arrow 68 by motor 38, as generally indicated by arrow 69, will help remove any additional sheets 44 of print medium below top sheet of medium 32 within separator nip 50 (i.e., singulate), that were inadvertently selected by pick assembly 20, back to media stack 30. Motor 38 provides a constant, limited torque to second roller 48 through a slip clutch 70, as generally indicated by arrow 72. Once second roller 48 is disengaged from motor 38 by slip clutch 70 (either because only sheet of medium 32 is in separator nip 50 or no sheet of medium is in separator nip 50), it is driven by first roller 46 to rotate in the direction generally indicated by dashed arrow 74. A one-way clutch 76 helps to prevent first roller 46 from being driven by second roller 48 to rotate in a direction generally opposite that of arrow 54, as generally indicated by arrow 78.

As can further be seen in FIG. 2, media handling system 10 additionally includes a feed assembly 58 downstream of separator assembly 42 along path or track 80. Feed assembly 58 includes a first roller 82 rotatably mounted on a shaft 84 and a second roller 86 rotatably mounted on a shaft 88 and adjacent first roller 82 to define a nip 90. Motor 38 is connected to feed assembly 58, as generally indicated by arrow 92, to rotate first roller 82 in the direction of arrow 83 which helps transport selected top sheet of medium 32 between nip 90 from separator assembly 42 toward print zone 16 along track or path 80.

Figure 3A:
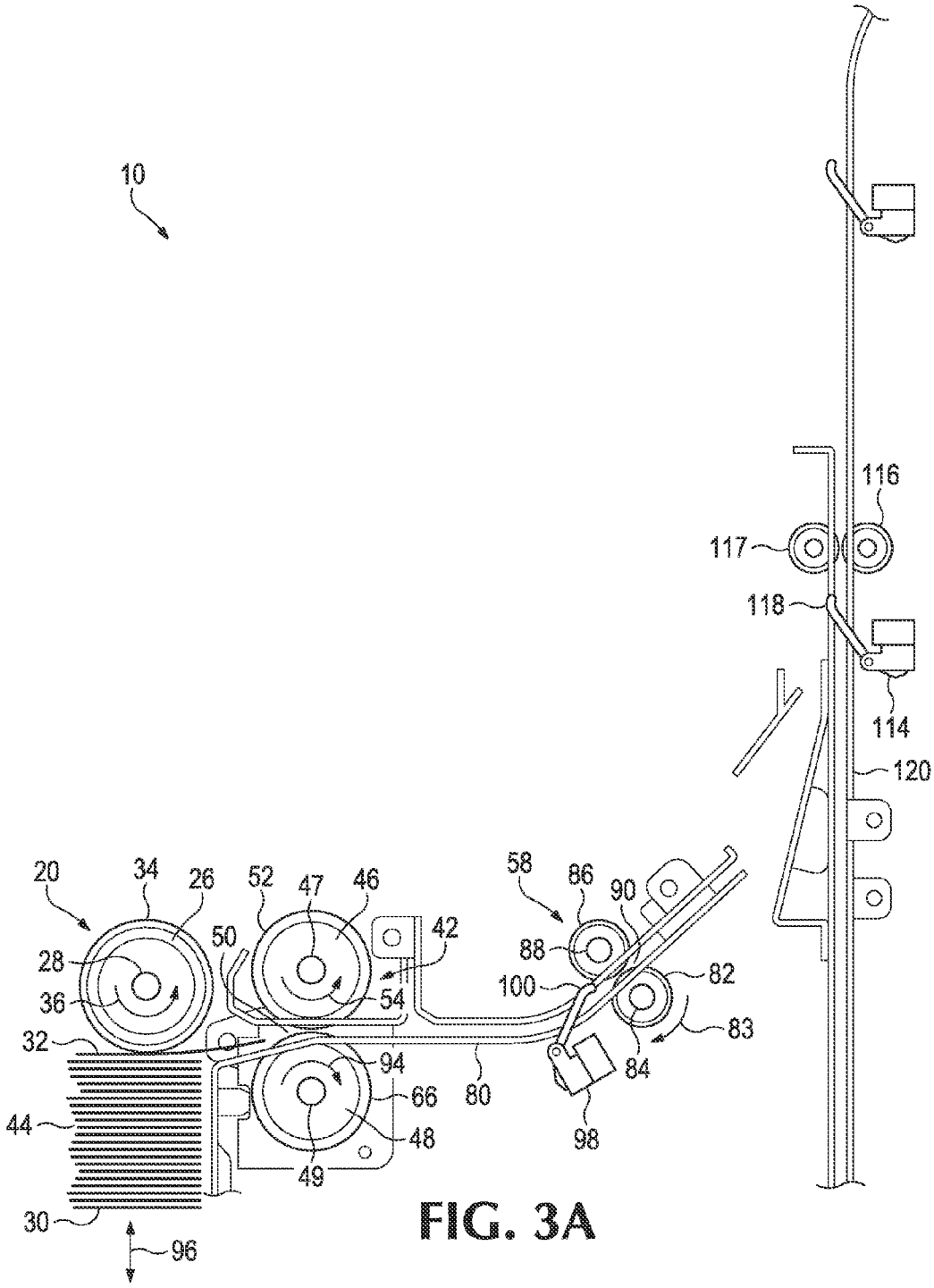
FIGS. 3A-3E illustrate examples of the operation of media handling system of FIGS. 1 and 2.

The operation of media handling system 10 is discussed in more detail below in connection with exemplarily FIGS. 3A-3E. It should be noted, some of the components of media handling system discussed above in connection with FIG. 2 (e.g., processor 22, non-transitory storage medium 24, motor 38, electric clutch 40, etc.) are not illustrated in FIGS. 3A-3E, but are nonetheless present and will be discussed below. As can be seen in FIG. 3A, instructions of non-transitory storage medium 24 (see FIG. 2) have caused processor 22 (also shown in FIG. 2) to activate pick assembly 20 to select sheet of medium 32 from media stack 30. This is accomplished by processor 22 turning electric clutch 40 on (see FIG. 2) and activating motor 38 (also shown in FIG. 2) to rotate pick roller in the direction of arrow 36.

As can also be seen in FIG. 3A, sheet of medium 32 has failed to enter separator nip 50 of separator assembly 42. As can additionally be seen in FIG. 3A, instructions of non-transitory storage medium 24 have caused processor 22 to turn electric clutch 60 (see FIG. 2) on and to activate motor 38 to rotate first roller 46 of separator assembly 42 in the direction of arrow 54. Instructions of non-transitory storage medium 24 have also caused processor 22 to activate motor 38 to rotate second roller 48 of separator assembly 42 in the direction of arrow 68 (see FIG. 2), however slip clutch 70 (also shown in FIG. 2) is active because of the friction between surface 66 of second roller 48 and surface 52 of first roller at nip 50, causing second roller 48 to rotate in the direction of arrow 94 (which is the same direction as dashed arrow 74 in FIG. 2).

The inventors have discovered that this failure of medium sheet 32 to enter nip 50 of separator assembly 42 may be addressed as follows. Instructions on non-transitory storage medium 24 cause processor 22 to lower media stack 30 in media tray 12 (see FIG. 1) a predetermined amount relative to, for example, pick assembly 20 and then subsequently raise media stack 30 this predetermined amount, as generally indicated by double-headed arrow 96 in FIG. 3A and arrow 97 in FIG. 2. This operation helps unsettle sheets 44 of media, including top sheet of medium 32, by brushing them against side walls of media tray 12, helping to separate top sheet 32 from sheets 44 below. Additionally, this operation temporarily increases the pick normal force (PNF) between pick assembly 20 and sheet of medium 32. Both of these improve the likelihood of a subsequent successful pick operation by media handling system 10. Instructions of non-transitory storage medium 24 then cause processor 22 to activate pick assembly 20 again in another attempt to select sheet of medium 32 from media stack 30.

In one example, the predetermined amount that media stack 30 is lowered and then raised is substantially equal to six (6) millimeters (mm). Instructions of non-transitory storage medium 24 may cause processor 22 to attempt this media stack 30 movement and subsequent pick assembly 20 reactivation any number of predetermined times, before alerting an end user or operator of printing device 14 of a failure to successfully pick sheet of medium 32 from media stack 30. In one example, the predetermined number of times is thirty (30).

Figure 3B:
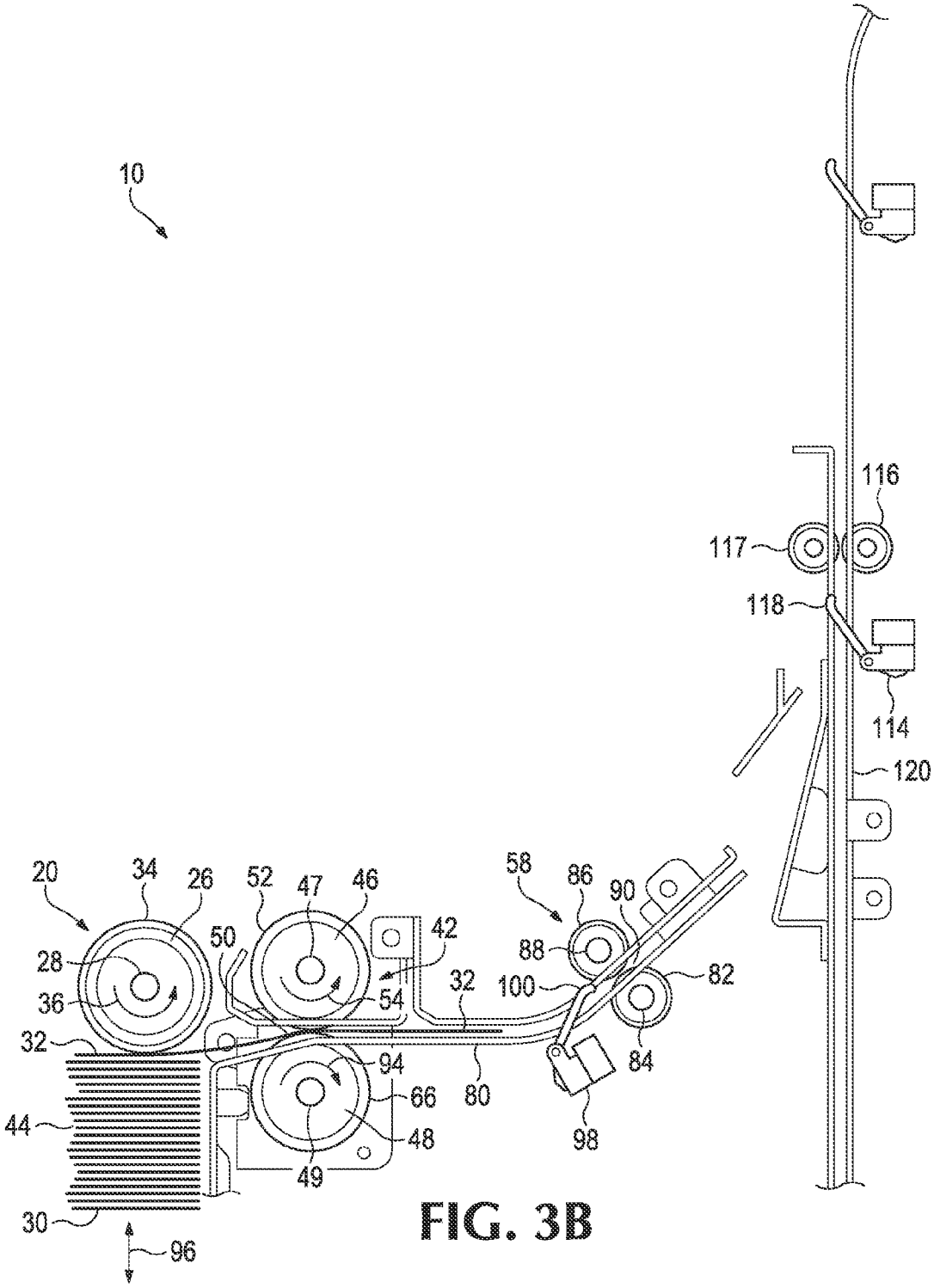

As can be seen in FIG. 3B, sheet of medium 32 has successfully entered separator nip 50 of separator assembly 42, but has failed to reach sensor 98 of media handling system 10 which is positioned downstream of pick assembly 20 and separator assembly 42, and upstream or in front of nip 90 of feed assembly 58. Sensor 98 is coupled to processor 22 to convey information to processor about whether medium sheet 32 has reached it. In the example shown in FIG. 3B, sensor 98 includes a flag 100 positioned within track or path 80 so as to deflect toward sensor 98 upon contact with medium 32. The inventors have also discovered that this failure of medium sheet 32 to reach sensor 98 may also be addressed by the above-described raising and lowering of media stack 30 a predetermined amount.

That is, instructions on non-transitory storage medium 24 cause processor 22 to lower media stack 30 in media tray 12 the predetermined amount and then subsequently raise media stack 30 this predetermined amount, as generally indicated by double-headed arrow 96. As discussed above, this operation helps unsettle sheets 44 of media, including top sheet of medium 32, by brushing them against side walls of media tray 12, helping to separate top sheet 32 from sheets 44 below. Additionally, this operation temporarily increases the pick normal force (PNF) between pick assembly 20 and sheet of medium 32. Both of these improve the likelihood of a subsequent successful pick operation by media handling system 10. Instructions of non-transitory storage medium 24 then cause processor 22 to activate pick assembly 20 again, along with first roller 46 of separator assembly 42, in another attempt to select sheet of medium 32 from media stack 30 and transport it to sensor 98 and into nip 90 of feed assembly 58.

Figure 3C:
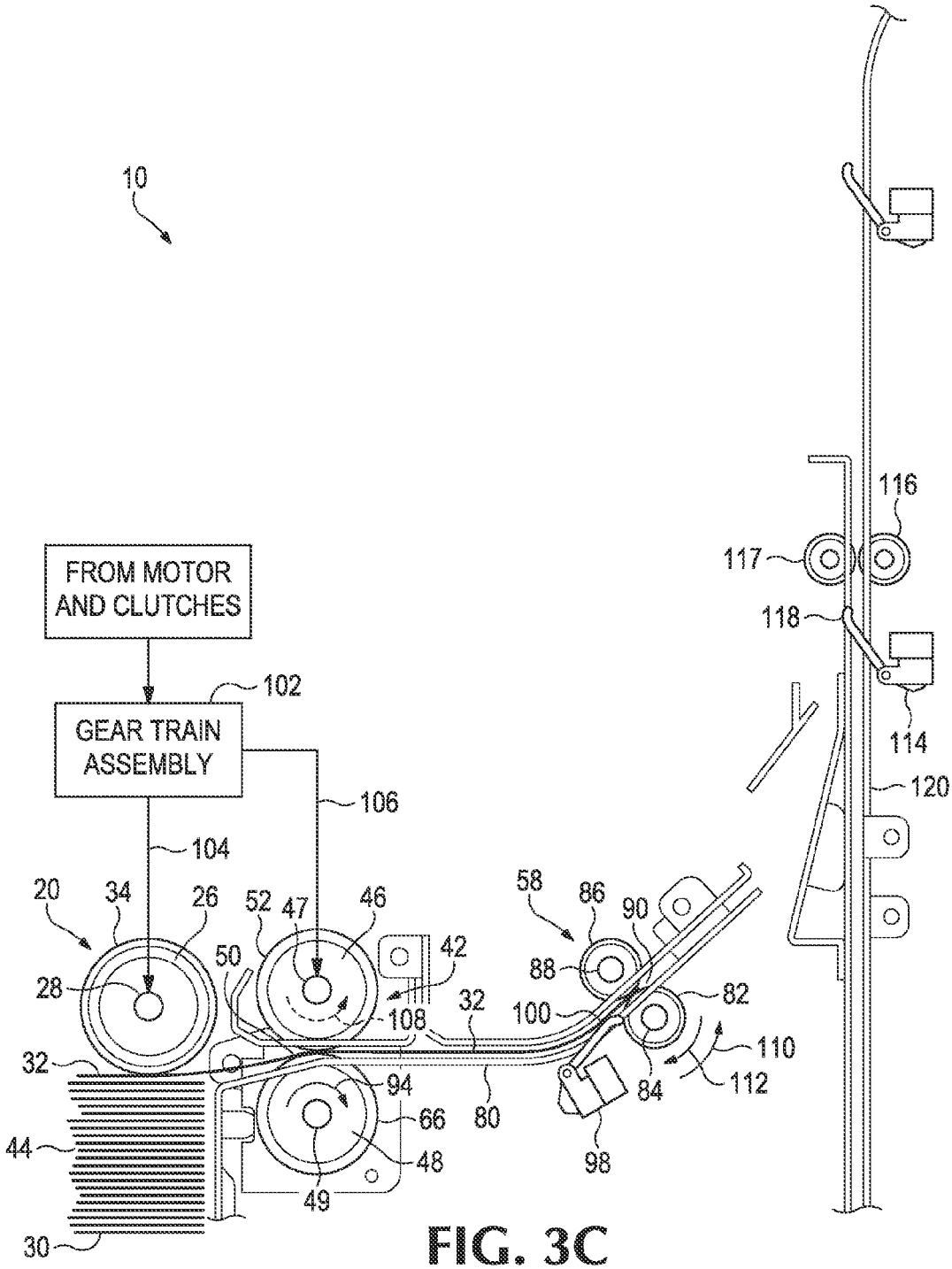

As can be seen in FIG. 3C, sheet of medium 32 has successfully reached sensor 98 and deflected or moved flag 100, but has failed to enter nip 90 of feed assembly 58 of media handling system 10 which is utilized to convey sheet of medium 32 toward print zone 16 of printing device 14. This may be caused, for example, by drag or friction between sheet of medium 32 and surface 66 of second roller 48 of separator assembly 42 which is slipping due to clutch 70, as discussed above. The inventors have additionally discovered that this failure of medium sheet 32 to enter nip 90 of feed assembly 58 may also be addressed as follows. This involves utilizing a backlash or predetermined delay present in a gear rain assembly 102 that is coupled between motor 38, clutches 40, 60, and 70 (see FIG. 2), pick assembly 20, and separator assembly 42, as generally indicated by arrows 104 and 106 in FIG. 3C. Gear train assembly 102 (diagrammatically illustrated in FIG. 3C) allows a single motor 38 to be utilized to rotate pick assembly 20, separator assembly 42, and feed assembly 58.

Instructions on non-transitory storage medium 24 cause processor 22 to deactivate pick assembly 20 by decoupling pick roller 26 from motor 38 by turning off electric clutch 40 (see FIG. 2). Instructions on non-transitory storage medium 24 also cause processor 22 to deactivate first roller 46 of separator assembly 42 from motor 38 by turning off electric clutch 60. Instructions on non-transitory storage medium 24 then cause processor 22 to activate separator assembly 42 to move in a first direction for a period at least as great as the predetermined delay in gear train assembly 102. That is, these instructions on non-transitory storage medium 24 cause processor 22 to reverse a direction of rotation of motor 38 which causes second roller 48 of separator assembly 42 to actively rotate in the direction of arrow 94, rather than being actively driven in the direction of arrow 68 (see FIG. 2) or passively driven in the direction of arrow 94 by first roller 46 (which is disengaged from motor 38 because processor has turned electric clutch 60 off) and slip clutch 70.

It should be noted that first roller 46 is prevented from rotating in a reverse direction from that indicated by arrow 54 (see FIG. 2) by one-way clutch 76 (also shown in FIG. 2), as generally indicated by dashed arrow 108 in FIG. 3C. It should be further noted, that first roller 82 of feed assembly 58 is rotated by motor 38 in the direction of arrow 110 during this operation or procedure, but this has no affect on sheet of print medium 32 because it has failed to enter nip 90.

Additional instructions on non-transitory storage medium 24 next cause processor 22 to reactivate pick assembly 20 by coupling pick roller 26 to motor 38 by turning on electric clutch 40. These instructions on non-transitory storage medium 24 also cause processor 22 to change the direction of rotation of motor 38 to the original or unreversed direction so that pick roller 26 of pick assembly 20 again rotates about shaft 28 via gear train assembly 102 in the direction indicated by arrow 36 in FIG. 2.

Further instructions on non-transitory storage medium 24 cause processor 22 to reactivate first roller 46 of separator assembly 42 by connecting it to motor 38 by turning on electric clutch 60. This causes first roller 46 of separator assembly 42 to move in the first direction (i.e., the direction of arrow 54 shown in FIG. 2) while second roller 48 freely rotates in the first direction (i.e., the direction of arrow 94 in FIG. 3C) for the predetermined delay or backlash present in gear train assembly 102. This significantly reduces drag or friction between sheet of medium 32 and surface 66 of second roller 48 of separator assembly 42 which helps it enter nip 90 of feed assembly 58. As can also be seen in FIG. 3C, first roller 82 of feed assembly 58 is now being driven in the direction of arrow 112 by motor 38 which additionally facilitates entry of sheet of medium 32 into nip 90. Once the predetermined delay or backlash present in gear train assembly 102 is overcome, second roller 48 of separator assembly 42 is driven in a second direction (illustrated by arrow 68 in FIG. 2) by motor 38, but actually moves in the direction of arrow 94 in FIG. 3C because of the above-described action of slip clutch 70.

In one example, the predetermined period or rotational backlash of gear train assembly 102 amounts to approximately one hundred twenty degrees (120°) of rotation of second roller 48 of separator assembly 42. Instructions of non-transitory storage medium 24 may cause processor 22 to attempt this procedure or method illustrated in FIG. 3C any number of predetermined times, before alerting an end user or operator of printing device 14 of a failure to successfully enter nip 90 of feed assembly 58 (which may require the user or operator to clear this jam). In one example, the predetermined number of times is ten (10).

Figure 3D:
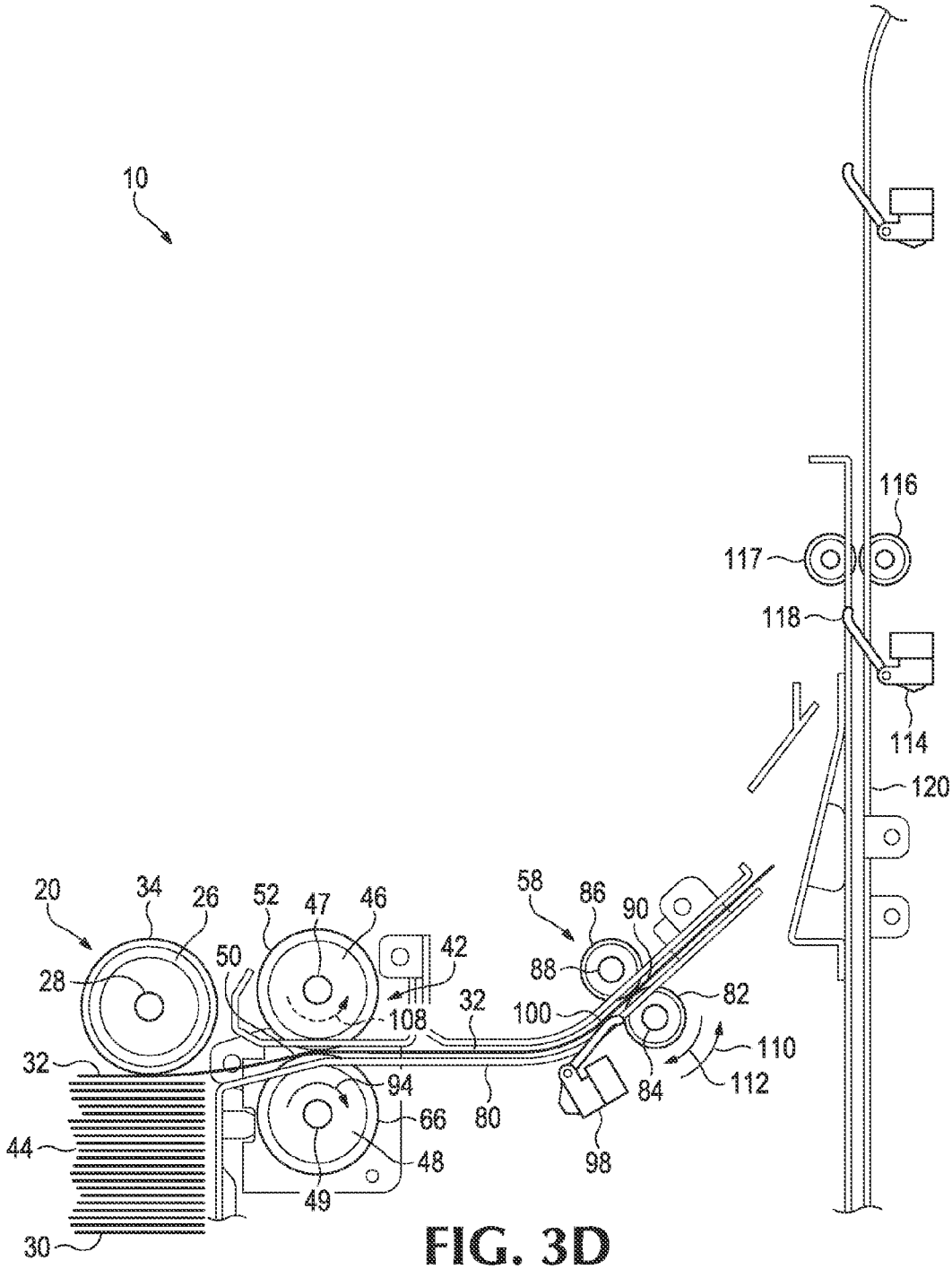
Figure 3E:
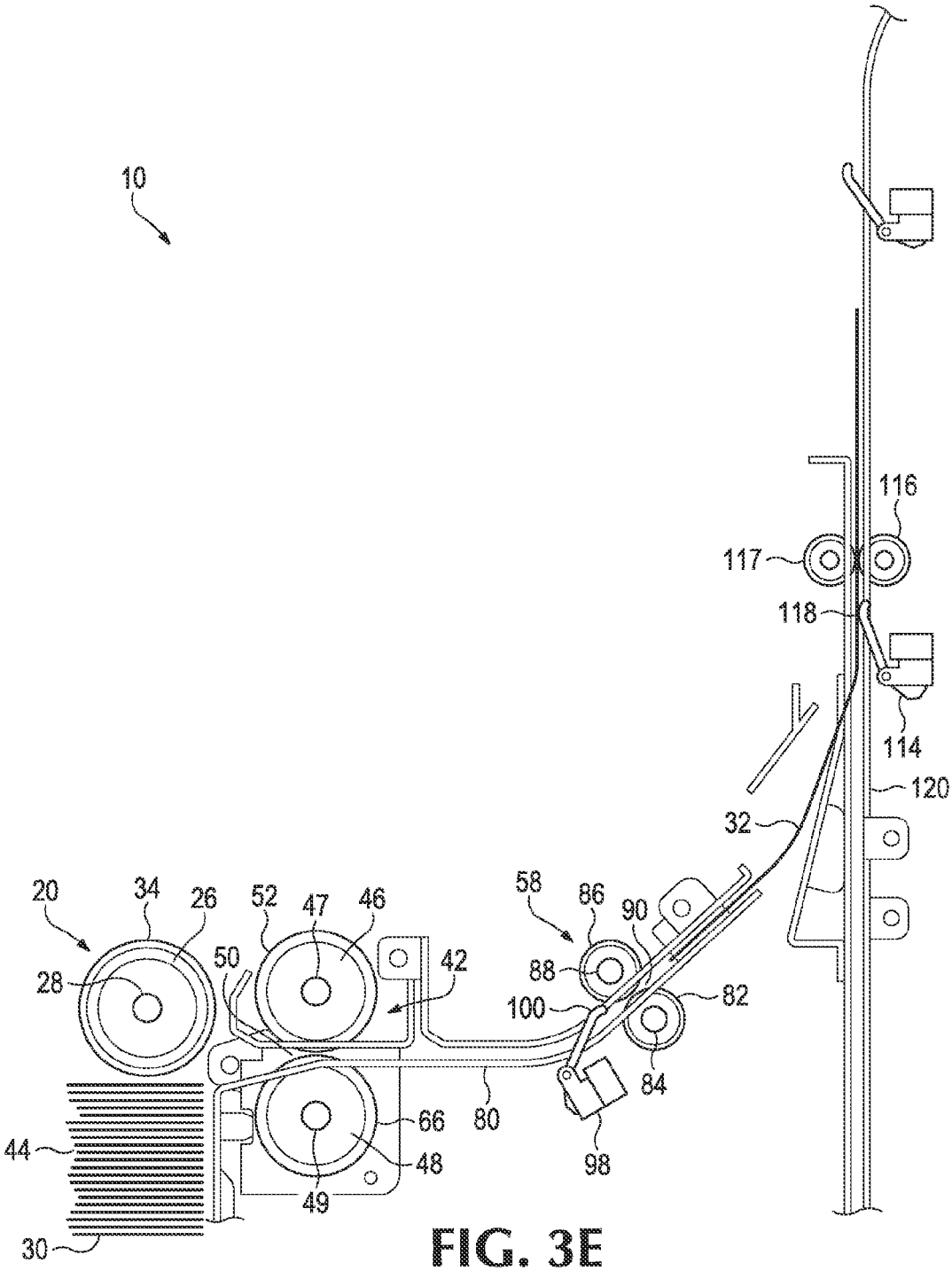

As can be seen in FIG. 3D, sheet of medium 32 has successfully entered separator nip 90 of separator assembly 42, but has failed to reach sensor 114 of media handling system 10 which is positioned downstream of feed assembly 58 and upstream or in front of rollers 116 and 117 which eventually take over for feed assembly 58, as shown in FIG. 3E, which, along with pick assembly 20 and separator assembly 42, may be turned off or utilized to select the next sheet of medium (not shown) from media stack 30.

Sensor 114 is coupled to processor 22 to convey information to processor about whether medium sheet 32 has reached it. In the example shown in FIG. 3D, sensor 114 includes a flag 118 positioned within track or path 120 so as to deflect toward sensor 114 upon contact with medium 32. The inventors have further discovered that this failure of medium sheet 32 to reach sensor 114 may also be addressed by the above-described procedure or method illustrated in FIG. 3C.

Figure 4:
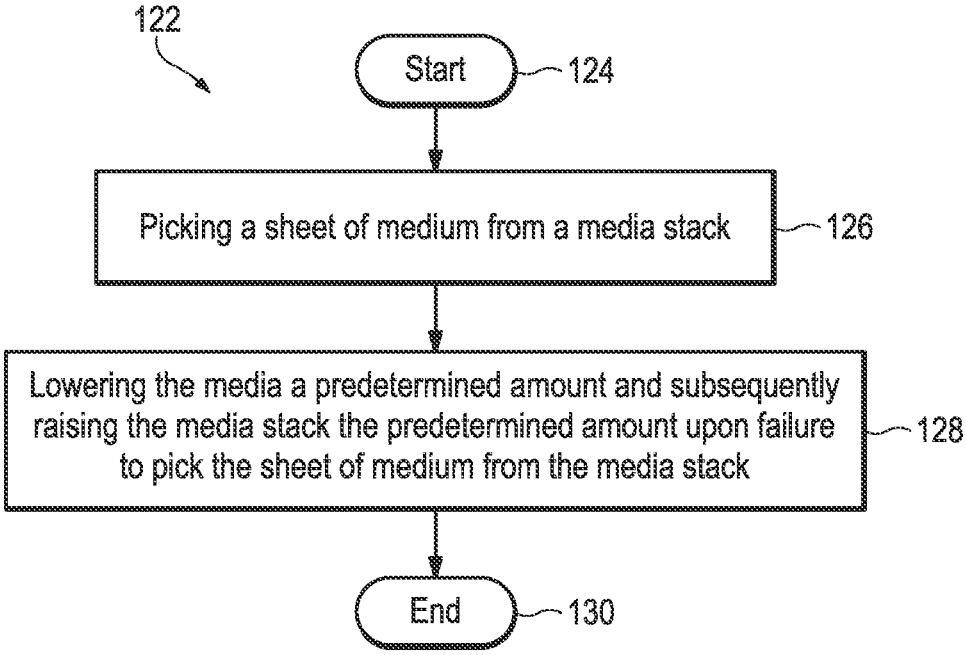
FIG. 4 is an example of a media handling method.

An example of a method of media handling 122 is shown in FIG. 4. As can be seen in FIG. 4, method 122 begins 124 by picking a sheet of medium from a media stack, as indicated by block 126, and then lowering the media a predetermined amount and subsequently raising the media stack the predetermined amount upon failure to pick the sheet of medium from the media stack, as indicated by block 128. Method 122 may then end 130.

Figure 5:
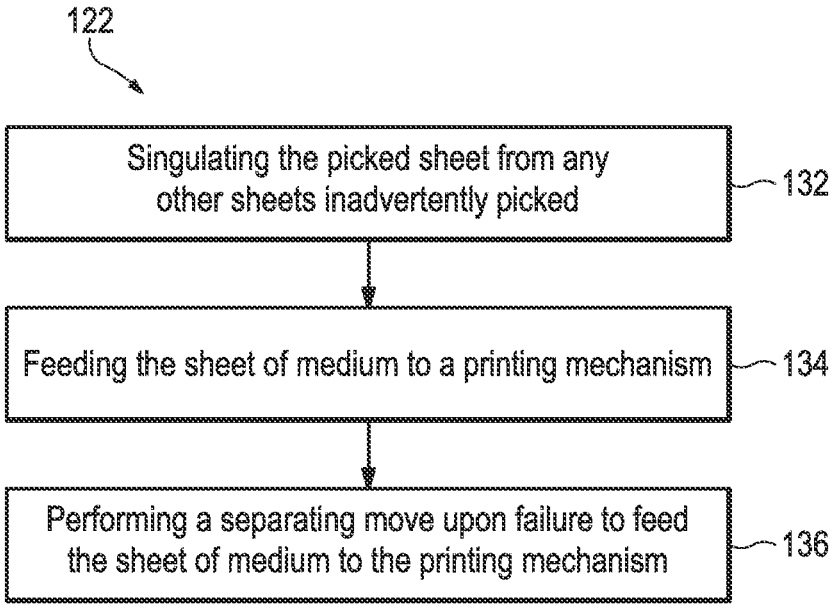
FIG. 5 is an example of additional elements of the media handling method of FIG. 4.

As can be seen in FIG. 5, method 122 may continue by singulating the picked sheet from any other sheets inadvertently picked, as indicated by block 132. As also shown in FIG. 5, method 122 may next or alternatively continue by feeding the sheet of medium to a printing mechanism, as indicated by block 134, and then performing a separating move like that discussed above, for example, in connection with FIG. 3C, upon failure to feed the sheet of medium to the printing mechanism, as indicated by block 136.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A non-transitory storage medium including instructions that, when executed by a processor, cause the processor to perform a method of media handling, the method comprising:

actuating a pick assembly of a media handling system to select a sheet of medium from a media stack; and lowering the media stack a predetermined amount and subsequently raising the media stack the predetermined amount upon failure to select the sheet of medium from the media stack.

2. The non-transitory storage medium of claim 1, further including additional instructions that, when executed by the processor, cause the processor to perform the method of media handling, the method further comprising:

singulating the selected sheet from any other sheets inadvertently selected by the pick assembly.

3. The non-transitory storage medium of claim 1, further including additional instructions that, when executed by the processor, cause the processor to perform the method of media handling, the method further comprising:

activating a separator assembly of the media handling system to move in a first direction for a predetermined period in those instances where the sheet fails to reach a feed assembly of the media handling system; and activating the separator assembly to move in a second direction after the predetermined period.

4. The non-transitory storage medium of claim 1, further comprising a printing device.

5. A media handling system, comprising:

a pick assembly;

a first sensor downstream of the pick assembly;

a processor; and a non-transitory storage medium including instructions that, when executed by the processor, cause the processor to:

activate the pick assembly to select a sheet of medium from a media stack, and lower the media stack a predetermined amount relative to the pick assembly and subsequently raise the media stack the predetermined amount in those instances where the sheet fails to reach the first sensor.

6. The media handling system of claim 5, further comprising:

a feed assembly defining a nip; and a separator assembly to singulate the sheet from any other sheets inadvertently selected by the pick assembly, wherein the separator assembly has a predetermined delay, and further wherein the non-transitory storage medium includes additional instructions that, when executed by the processor, cause the processor to:

deactivate the pick assembly in those instances where the sheet fails to enter the nip, activate the separator assembly to move in a first direction for a period at least as great as the predetermined delay, activate the pick assembly, and activate the separator assembly to move in a second direction after the predetermined delay.

7. The media handling system of claim 6, further comprising a printing device.

8. A media handling system, comprising:

a pick roller;

a separator assembly including a first roller and a second roller adjacent the first roller to define a separator nip;

a processor; and a non-transitory storage medium including instructions that, when executed by the processor, cause the processor to:

rotate the pick roller to select a sheet of medium from a media stack, rotate the first roller in a first direction and the second roller in a second direction generally opposite the first direction to singulate the sheet from any other sheets inadvertently selected by the pick roller, and lower the media stack a predetermined amount relative to the pick roller and subsequently raise the media stack the predetermined amount relative to the pick roller in those instances where the sheet fails to enter the separator nip.

9. The media handling system of claim 8, further comprising a sensor downstream of the pick roller and the separator assembly and wherein the non-transitory storage medium includes additional instructions that, when executed by the processor, cause the processor to lower the media stack the predetermined amount relative to the pick roller and subsequently raise the media stack the predetermined amount in those instances where the sheet fails to reach the sensor.

10. The media handling system of claim 8, further comprising:

a feed roller assembly defining a feed roller nip;

a motor; and a gear train assembly to couple the pick roller and the separator assembly to the motor.

11. The media handling system of claim 10, wherein the gear train assembly has a predetermined rotational backlash and further wherein the non-transitory storage medium includes additional instructions that, when executed by the processor, cause the processor to:

decouple the pick roller and the first roller of the separator assembly from the motor via the gear train assembly in those instances where the sheet fails to enter the feed roller nip, reverse a direction of rotation of the motor to rotate the second roller of the separator assembly in the first direction via the gear train assembly through an angle at least as great as the predetermined rotational backlash of the gear train assembly, couple the pick roller and the first roller of the separator assembly to the motor via the gear train assembly, and change a direction of rotation of the motor to:

rotate the pick roller via the gear train assembly, rotate the first roller in the first direction via the gear train assembly, and rotate the second roller in the second direction once the predetermined rotational backlash of the gear train assembly is overcome.

12. The media handling system of claim 11, further comprising a printing device.

13. A media handling method comprising:

picking a sheet of medium from a media stack; and lowering the media stack a predetermined amount and subsequently raising the media stack the predetermined amount upon failure to pick the sheet of medium from the media stack.

14. The media handling method of claim 13, further comprising singulating the picked sheet from any other sheets inadvertently picked.

15. The media handling method of claim 13, further comprising:

feeding the picked sheet of medium to a printing mechanism; and performing a separating move upon failure to feed the sheet of medium to the printing mechanism.

* * * * *